United States Patent [19]

Neal

[11] Patent Number: 4,492,518

[45] Date of Patent: Jan. 8, 1985

[54] GAS TURBINE ENGINE BEARING SUPPORT STRUCTURE

[75] Inventor: Peter F. Neal, Castle Donington, England

[73] Assignee: Rolls-Royce Limited, London, England

[21] Appl. No.: 457,234

[22] Filed: Jan. 11, 1983

[30] Foreign Application Priority Data

Feb. 12, 1982 [GB] United Kingdom ..... 8204170

[51] Int. Cl.[3] ..... F01D 25/16

[52] U.S. Cl. ..... 415/142; 415/138; 415/174; 415/195; 308/DIG. 14

[58] Field of Search ..... 415/142, 138, 195, 170, 415/501, 134, 135, 136, 137, 174; 416/244 A, 244 R; 308/DIG. 14; 384/441

[56] References Cited

U.S. PATENT DOCUMENTS

| | | | |
|---|---|---|---|
| 691,123 | 1/1902 | Farwell | 415/142 |
| 1,379,579 | 5/1921 | Ostenberg | 415/142 |
| 1,966,787 | 7/1934 | Buri | 415/142 |
| 2,640,427 | 6/1953 | Domer | 415/142 |
| 2,941,781 | 6/1960 | Boyum | 415/142 |
| 3,909,156 | 9/1975 | Stahl | 415/142 |
| 3,995,970 | 12/1976 | Yamaguchi | 415/119 |
| 4,427,337 | 1/1984 | Dickinson et al. | 415/174 |

FOREIGN PATENT DOCUMENTS

| | | | |
|---|---|---|---|
| 1557096 | 12/1979 | United Kingdom | 415/170 R |

*Primary Examiner*—Samuel Scott
*Assistant Examiner*—Brian J. Bowman
*Attorney, Agent, or Firm*—Cushman, Darby & Cushman

[57] ABSTRACT

A gas turbine engine bearing support structure comprises a central hub which carries a bearing and which is supported by a plurality of spokes from a ring member. The majority of the spokes are radially extending so that each is perpendicular to an imaginary tangent at its point of intersection with the ring member. However, two of the spokes are not perpendicular but are inclined so that compressive loading on the spokes results in partial rotation of the central hub, thereby leading to compressive loads in the non-inclined spokes being partially relieved by localised bending.

4 Claims, 2 Drawing Figures

10
11
12
13
14
15
16
17
18
22
23

20
18a
23
18
16
19
15
22
17
21
18
20
18a

GAS TURBINE ENGINE BEARING SUPPORT STRUCTURE

This invention relates to a gas turbine engine structure for supporting a bearing.

Gas turbine engines contain a number of axially extending shafts, usually two or three, which support the main rotary components of the engine. These shafts are mounted on bearings which are in turn mounted on static portions of the engine by way of support structures. Each bearing support structure is frequently in the form of a radially spoked structure with the bearing mounted in a hub at its centre and the spokes interconnecting the hub with a support ring, which may constitute part of the casing of the engine. The spokes extend across the main gas passage through the engine and consequently must present as little resistance to the gas flow through that passage as possible whilst being sufficiently strong to provide adequate support.

It has been found in practice that the thermal gradients present in gas turbine engines and the loads imposed upon such bearing support structures by the bearings, and hence the shafts which they support, impose high levels of stress upon the spokes. In particular the spokes are liable to heavily loaded in compression and this can, in extreme cases, give rise to cracking and buckling of the spokes. Two separate approaches to this problem have been attempted in the past. The first is to increase the physical dimensions of the spokes so that they are capable of withstanding the loads. This is undesirable however in view of the weight penalties which result and also the increase in the area which the spokes present to the gas flow through the engine. The second is to incline each of the spokes with respect to an imaginary tangent at the point where the spoke intersects the support ring. This ensures that the spokes take radial loads from the bearing in bending rather than compression. However, inclination of all of the spokes increases their lengths, thereby resulting in a weight increase and in addition increases the area which the spokes present to the gas flow through the engine.

It is an object of the present invention to provide a gas turbine engine bearing support structure in which such problems are substantially avoided.

According to the present invention, a gas turbine engine bearing support structure comprises a central hub portion which receives and supports a bearing, and a plurality of spokes which lie in a plane which is perpendicular to the axis of said bearing and interconnect said central hub portion with an outer ring member which is located coaxially with said bearing axis, the majority of said spokes being radially extending so that each is perpendicular to an imaginary tangent at the point where it intersects said ring member, each of the remainder of said spokes being inclined with respect to an imaginary tangent at the point where it intersects said ring member, so that compressive loading of said inclined spokes by said hub portion and/or said ring member promotes limited rotation of said central hub portion relative to said ring member.

Said spokes which are inclined with respect to an imaginary tangent at their point of intersection with said ring member are preferably inclined to said imaginary tangent at an angle of up to 5°.

Two of said spokes are preferably inclined, said inclined spokes being so positioned as to be diametrically opposite each other.

Said ring member may constitute a portion of the casing of a gas turbine engine.

The invention will now be described, by way of example, with reference to the accompanying drawings in which.

Figure 1:
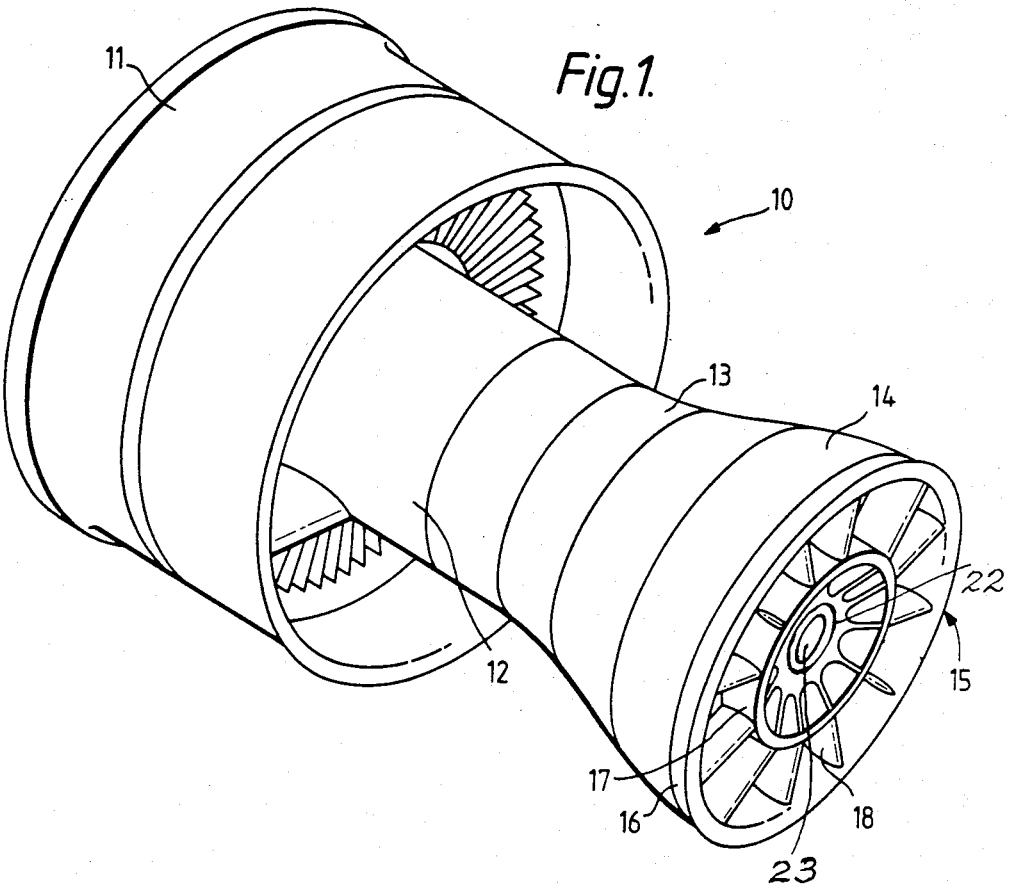
FIG. 1 is a rear threequarter view of a gas turbine engine which incorporates a bearing support structure in accordance with the present invention.

With reference to FIG. 1 a gas turbine engine 10, which is of the turbofan type, is of conventional construction. It comprises, in axial flow series, a propulsive fan 11, compressor equipment 12, combustion equipment 13 and turbine equipment 14. The gas turbine engin 10 would normally be provided with a propulsion nozzle downstream of the turbine equipment 14. However in FIG. 1, the propulsion nozzle has been omitted in order to show a bearing support structure 15 which is positioned immediately downstream of the turbine equipment 14.

Figure 2:
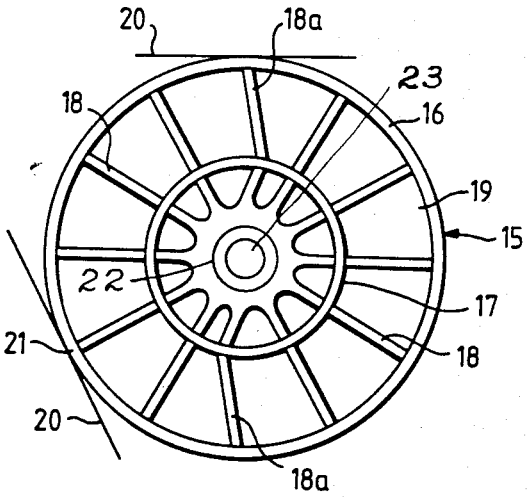
FIG. 2 is an end view of the bearing support structure incorporated in the gas turbine engine shown in FIG. 1.

The bearing support structure generally designated at 15, which can be seen more easily in FIG. 2 comprises a ring member 16 by means of which it is attached to the downstream end of the turbine equipment 14 although in certain cases, the ring member 16 may constitute a portion of the casing of the turbin equipment 14. The ring member 16 supports a central hub 17 by means of twelve spokes or struts 18, all of which lie in a plane which is perpendicular to the axis of the ring member 16. Thus the central hub portion 17 and the ring member 16 define an annulus 19 across which the spokes or struts 18 extend. The annulus 19 constitutes a rearward extension of the annular gas passage through the turbine equipment 14. Consequently during the operation of the gas turbine engine 10, hot gases exhausted from the turbine equipment 14 flow through the annulus 19 before passing into the propulsion nozzle of the engine 10 and thence to atmosphere.

The central hub generally designated at 17 receives and supports a conventional bearing shown diagrammatically at 22 the axis of which is coaxial with the axis of the ring member 16. The bearing 22 supports the downstream end of a shaft shown diagrammatically at 23 which links the fan 11 with the downstream end of the turbine equipment 14. Thus radial loads are transferred from the shaft 23 to the ring member 16 via the bearing 22, the central hub 17 and the spokes 18. Additional radial loads on the spokes 18 result from thermal gradients which are established both within the bearing support structure 15 and between it and surrounding structures.

In order to ensure that the bearing support structure 15 is as light as possible and that the spokes 18 provide at least resistance as possible to the flow of gas through the annulus 19, all of the spokes 18 are radially extending with the exception of two spokes identified as **18*a*. Thus each radially extending spoke 18 is perpendicular to an imaginary tangent 20 at the point 21 where it intersects the ring member 16. The remaining two spokes 18*a*, which are diametrically opposed, are however inclined by up to 5° with respect to the imaginary tangent 20 at the points where they intersect the ring member 16. This ensures that if radial loads are imposed upon the radially extending spokes 18, the inclined spokes 18*a* will promote partial rotation of the central hub 17 relative to the ring member 16. This in turn leads to compressive loads in the non-inclined radially extending spokes or struts 18 being partially relieved by localised bending. It will be seen therefore that by partially relieving the compressive loads in the non-inclined radially extending spokes or struts 18** the advantages of a bearing support structure having all spokes inclined are achieved without the attendant weight and gas flow obstruction disadvantages of such a structure.

Although the present invention has been described with reference to a bearing support structure 15 which is provided with two inclined spokes 18*a*, it will be appreciated that just one spoke or more than two spokes may be inclined depending upon the conditions which are likely to be encountered. However in order to achieve the advantages of the present invention, it is important that the majority of the spokes are non-inclined.

I claim:

1. A bearing support structure for a bearing and a shaft of a gas turbine engine, said bearing support structure comprising:

a central hub portion for receiving and coaxially supporting the bearing and the shaft;

a ring member spaced radially outwardly of said central hub portion, said ring member being coaxial with said central hub portion and defining therewith and annulus forming a portion of a gas passage through said gas turbine engine;

and means for receiving and transferring radial loads received by said central hub portion from said bearing and said shaft to said ring member, said means including a plurality of spokes all lying in a plane perpendicular to an axis of said central hub portion, said plurality of spokes interconnecting said central hub portion and said ring portion, a majority of said plurality of spokes extend radially of said axis of said central hub portion and are perpendicular to an imaginary tangent at a point of intersection with said ring member and a remaining minority of said plurality of spokes extend at an incline to an imaginary tangent at a point of intersection with said ring member whereby loading of said inclined spokes promotes limited rotation of said central hub portion relative to said ring member and causes localized bending of said radially extending spokes to partially relieve compressive loads in said radially extending spokes.

2. A bearing support structure as claimed in claim 1 wherein said spokes which are inclined with respect to an imaginary tangent at their point of intersection with said ring member are inclined to said imaginary tangent at an angle of up to 5°.

3. A bearing support structure as claimed in claim 1 wherein two of said spokes are inclined, said inclined spokes being positioned diametrically opposite each other.

4. A bearing support structure as claimed in claim 1 wherein said ring member constitutes a portion of a casing of the gas turbine engine.

* * * * *